US006206008B1

(12) United States Patent
Matteau et al.

(10) Patent No.: US 6,206,008 B1
(45) Date of Patent: Mar. 27, 2001

(54) MAKE YOUR OWN CIGARETTES

(75) Inventors: Robert Matteau, Laval; Luc Gaetan Duplessis, Montreal; Michael Cardone, Brossard; Marcel Champagne, Dollard-des-Ormeaux, all of (CA)

(73) Assignee: Imperial Tobacco Canada Limited (CA)

( * ) Notice: Subject to any disclaimer, the term of this patent is extended or adjusted under 35 U.S.C. 154(b) by 0 days.

(21) Appl. No.: 09/269,120

(22) PCT Filed: Aug. 22, 1997

(86) PCT No.: PCT/CA97/00605

§ 371 Date: Mar. 19, 1999

§ 102(e) Date: Mar. 19, 1999

(87) PCT Pub. No.: WO98/07338

PCT Pub. Date: Feb. 26, 1998

(30) Foreign Application Priority Data

Aug. 23, 1996 (CA) ..... 2184035
Dec. 12, 1996 (CA) ..... 2192760

(51) Int. Cl.[7] ..... A24B 1/04; A24B 1/00; A24D 1/02; A24D 3/06

(52) U.S. Cl. ..... 131/361; 131/365; 131/360; 131/331; 131/336; 131/358

(58) Field of Search ..... 131/361, 365, 131/360, 331, 335, 336, 358

(56) References Cited

U.S. PATENT DOCUMENTS 4,005,717 * 2/1977 Brackmann et al. ..... 131/84.3
4,984,588 * 1/1991 Stewart, Jr. ..... 131/364

FOREIGN PATENT DOCUMENTS

| | | |
|---|---|---|
| 2056699 | 12/1998 | (CA) . |
| 41 07 026 C1 | 3/1992 | (DE) . |
| 93 19 938 U | 3/1994 | (DE) . |
| 44 14 604 A1 | 1/1995 | (DE) . |
| 1047015 | 11/1962 | (GB) . |
| 1216487 | 12/1970 | (GB) . |
| 2 095 532 | 10/1982 | (GB) . |
| WO 92/08377 | 5/1992 | (WO) . |

* cited by examiner

*Primary Examiner*—James Derrington
*Assistant Examiner*—Dionne A. Walls
(74) *Attorney, Agent, or Firm*—Wolf, Greenfield & Sacks, PC

(57) ABSTRACT

A non-smokable tobacco product comprises a rod-shaped element of cigarette tobacco with a filter element at one end and both enclosed by a tubular wrapper. The product is rendered unsmokable by a perforation extending through the wrapper of the tobacco or the filter element so that when air is drawn through the filter substantially all of the air enters through those perforations, there being insufficient air flow through the tip end to propagate normal cigarette combustion of the tobacco at that location or to permit any appreciable amount of smoke reaching the smoker's mouth. The product is rendered smokable by the user covering the perforated region of the wrapper by means of a strip, a sliding band, or a ring which blocks air flow through the perforations and thus converts the product into a self-made cigarette that can be smoked in the manner of a regular cigarette.

8 Claims, 3 Drawing Sheets

MAKE YOUR OWN CIGARETTES

This invention relates to a new or improved non-smokable tobacco product, to a method for its manufacture, and to the non-smokable tobacco product in combination with an element which can render it smokable.

There has long been a demand among a certain segment of the smoking population for self-made or roll-your-own cigarettes. Traditionally these have involved the smokers purchasing a supply of fine-cut cigarette tobacco and a supply of wrapping material such as cigarette papers, and making cigarettes by rolling a charge of tobacco onto a cigarette paper, forming the latter into a tubular rod-like form and sealing it around the tobacco. This process when performed manually is quite difficult and in fact it is virtually impossible for the user to fabricate anything approximating a machine-made cigarette.

Over the years various aids have been devised for facilitating the roll-your-own cigarette fabricating process, and while some of these have had a fair measure of success, in terms of the quality of the product even the best of them has scarcely been able to produce an adequate substitute for a machine-made cigarette. Still the demand for roll-your-own cigarette-making supplies persists, this being in part due to the more favourable tax treatment enjoyed by these in comparison to conventional machine-made cigarettes.

One system for self-made cigarettes that has enjoyed a measure of commercial success is that described in Canadian Patent 1,271,389 of EFKA-Werke Frita Kiehn GbmH. In this system a preformed factory made product in the form of a rod of tobacco having an air permeable outer surface is provided for use in combination with a preformed cigarette paper tube having a filter element at one end thereof. To assemble a smokable cigarette the tobacco rod is inserted into the cigarette paper tube, the latter having a diameter corresponding to that of the rod. This system is not entirely satisfactory however since some people have difficulty in inserting the tobacco rod into the paper tube. The empty tubes are of very delicate form and are easily crushed, thus making the insertion step even more difficult. Finally the combined volume of the rod and the tube is approximately twice that of the made-up cigarette so that very capacious packaging is required. Furthermore the packaging must be strong to protect the delicate tubes from crushing.

Other examples of non-smokable tobacco products are shown in DE 93 19 938 U Fabriques de Tabac Réunies S. A. where all or part of the mouthpiece surrounding the filter may be porous, the product being rendered smokable by a flat-shaped sheet or by a casing that can be moved over the most extremely porous part of the filter. Where a casing is to be used for this purpose, there is no disclosure as to how the casing is matched to the circumference of the filter or how air leakage past the casing can be avoided.

The present invention provides a tobacco product comprising: a rod-shaped element of cigarette tobacco coaxially interconnected to a rod-shaped filter element, with respective first ends of said elements adjoining; a tubular wrapper enclosing said tobacco element, said wrapper being of smokable material; the first end of said filter element being wrapped by and adhered to a circumferential strip of material that is carried by said tobacco element; said filter element having a peripheral surface that is highly porous thus rendering said product unsmokable in that when air is drawn from said product through the second free end of said filter element, the major portion of such air is drawn through said highly porous peripheral surface and any air flow drawn longitudinally through said tobacco element is insufficient to propagate combustion at the tip end thereof or to cause any appreciable amount of smoke to flow through said filter element to the second end thereof; in combination with a preformed tubular band of flexible substantially impervious material having a width corresponding to that of the highly porous surface of said filter element, and a circumference corresponding to that of said product, said band being slidable on said product to a position overlying said highly porous peripheral surface to render said product smokable.

The total area of the porous surface is selected to ensure that less than 9% of the air flow drawn from the filter will enter the product through the tip of the tobacco element and preferably 90% or more of such air flow will enter the product through the perforations. As is known, auxiliary ventilation holes may be included in the peripheral surface of the filter element and through which some air will enter when air is drawn through the filter. In the present invention, the total porous area is selected to ensure that the sum total of the air flow through the porous area is 90% or more of the air flow that passes longitudinally through the free second end of the filter element. The porous area provides a permeability of at least 1500 and preferably from 5,000 to 10,000 Coresta units (cc/min/cm$^2$). The permeability may vary over a large range provided that in the resultant product the porous area ensures that insufficient air, i.e. less than 9%, can be drawn through the product from the tip end. This ensures that the product cannot be smoked.

When air is drawn through the filter as in the act or simulated act of smoking, although by far the major part of such air will enter through the porous area, some small percentage of air flow may still enter at the tip end of the article and pass longitudinally through the tobacco rod. The amount of such air flow must be minimized to the extent that it is insufficient to propagate the combustion of the tobacco, so that even if the tip end of the tobacco rod is lit, there will be insufficient air flow to propagate combustion during puffing. Such air flow through the tobacco rod can be controlled to some extent by control of the packing density of the tobacco of the rod, and in this connection it is preferred that the packing density be greater in the vicinity of the tip end than elsewhere in the length of the tobacco rod. Alternatively such air flow through the tobacco rod may also be controlled to some extent by controlling the packing density to an extent that will provide an increase in the resistance to flow in the tobacco element relative to that resistance to flow as offered by the porous surface area of the filter element. The porous peripheral surface of the filter element may extend over the entire length thereof, or over a limited region of the length.

The tubular tobacco wrapper is of a smokable material. In a preferred embodiment it is of a burn-retardant cigarette paper which has a limited permeability to the flow of air therethrough. Other materials of course could be used, for example real or reconstituted tobacco leaf etc.

In yet another embodiment there may be an additional short tobacco element positioned between the main tobacco element and the filter element. In all cases the components of the product are secured together by a flexible strip of paper or the like wrapped around their adjoining ends. This strip may be of highly porous material, or may be substantially impervious.

The invention will further be described, by way of example only, with reference to the accompanying drawings, wherein.

Figure 1:
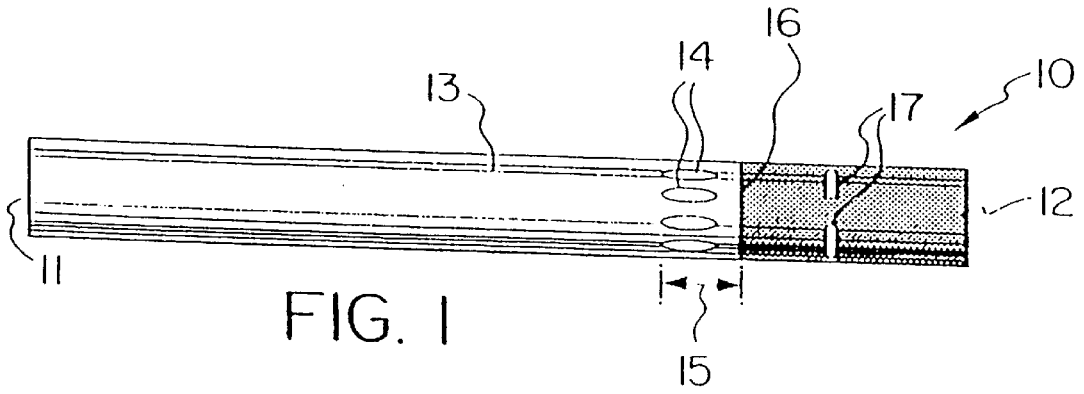
FIG. 1 is a side elevational view of an embodiment of a non-smokable tobacco product.

Referring to FIG. 1, the non-smokable tobacco product 10 illustrated therein comprises a rod-shaped element 11 of fine cut tobacco which is abutted against a rod-shaped filter element 12, the elements 11 and 12 being enclosed within a tubular wrapper 13. The product 10 is unsmokable because of a series of elongate perforations or holes 14 extending in a peripheral band completely around the article in a region 15 which registers with the end of the tobacco element 11 adjacent the junction 16 between the latter and the filter element 12. In addition there are a series of ventilation holes 17 which penetrate the wrapper 13 within the length of the filter rod 12. The non-smokable product 10 has dimensions corresponding to those of a normal machine-made cigarette, having a diameter of approximately 8 mm, and a length corresponding to some standard cigarette length, e.g. regular size or king size. The cigarette dimensions could also be of luxury length (99 mm to 102 mm), or of a different circumference such as 23 mm or less (diameter of 7.3 mm or less). The tobacco element 11 is packed to a density corresponding to or higher than that of the tobacco in a machine-made cigarette, and the filter element 12 may be any of the types of filter commonly used in cigarettes. The holes 14 extend over a region 15 in the length of the product which is of the same order as its diameter and have a total area which gives permeability to air flow of 1500±500 Coresta units (cc/min/$cm^2$). With this arrangement, the product 10 is unsmokable because of the holes 14 such that when air is drawn from the filter end of the product as in a simulated act of smoking, over 90% of the air flow enters the product through the holes 14 so that only a minimal amount of the air flow enters through the tip end of the tobacco element 11, such minimal amount being insufficient to propagate combustion of the tobacco during puffing.

The material of the wrapper 13 is a conventional cigarette wrapper, e.g. phosphate treated paper of low permeability to the flow of air therethrough. The use of a low-permeability paper is also generally effective to slow the smouldering of cigarette products once lit. In the embodiment shown, a small amount, of the order of 20%, of the air flow drawn from the filter element 12 will enter through the ventilation holes 17 and another amount, of the order of 70%, will enter through the ventilation holes 14.

Figure 2:
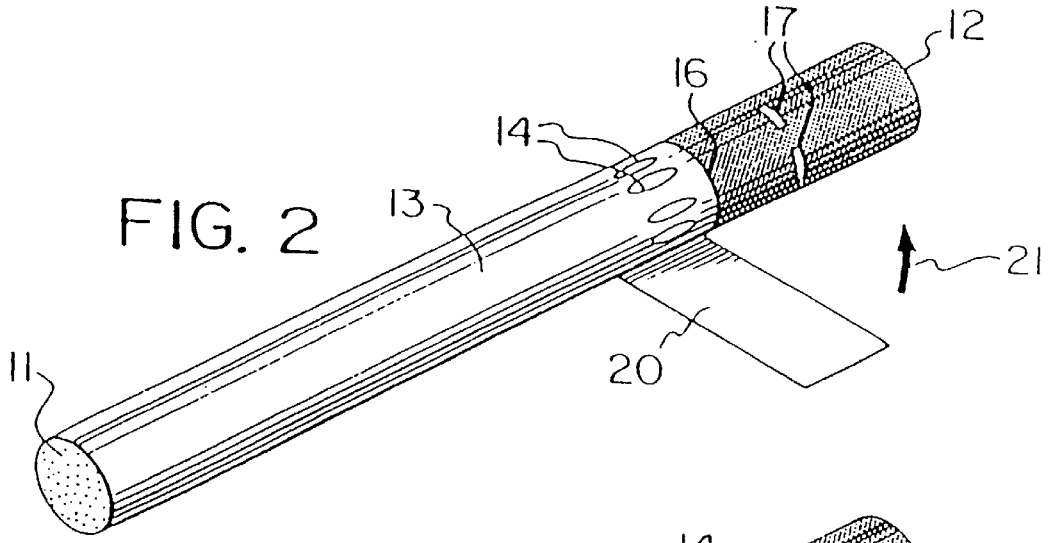
FIG. 2 is a perspective view to a smaller scale illustrating a step in converting the product of FIG. 1 into a smokable cigarette.
Figure 3:
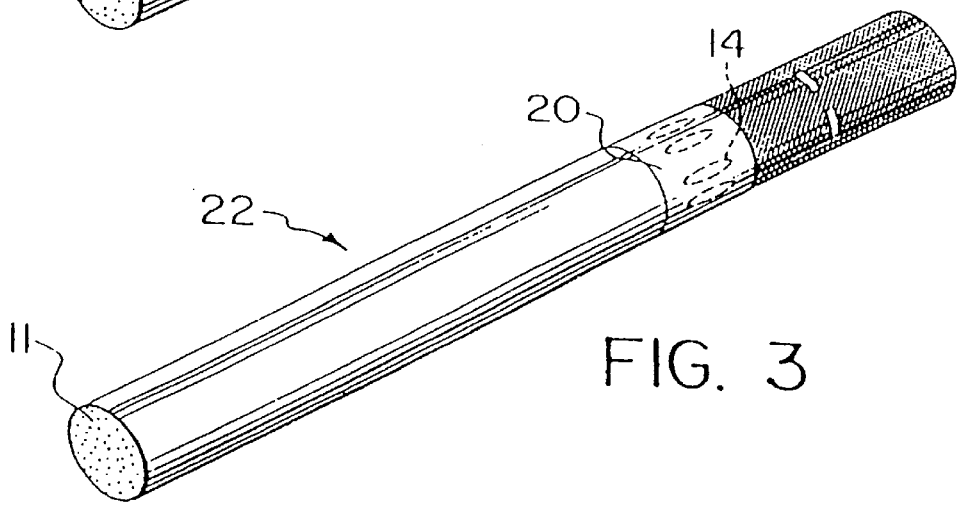
FIG. 3 is a view similar to FIG. 2 showing the cigarette that is produced.

To convert the non-smokable product 10 into a smokable cigarette, it is used in combination with a flexible sealing band 20 which has a length somewhat greater than the circumference of the product 10 and a width which exceeds the length of the region 15. The band is self-adhesive, and once brought into contact with the product 10 in alignment with the holes 14 as shown in FIG. 2 can be wrapped therearound in the direction of the arrow 21 to completely encircle the product 10, closing off the holes 14 and thus converting the article 10 into a smokable cigarette 22 as seen in FIG. 3.

The non-smokable products 10 can be packaged in any convenient quantities and in this respect are dimensionally quite similar to cigarettes which typically are provided in packs of 20 or 25 articles. The combination of the non-smokable product 10 and the corresponding sealing band 20 occupies approximately the same space as a regular cigarette. In the embodiment shown, the sealing band 20 has a dimension of approximately 8 mm in width by 27 mm to 30 mm in length. A package containing 25 units of the non-smokable product 10 will include a corresponding number of sealing bands 20 provided on a backing sheet (not shown) and peelable therefrom at the time of use. The backing sheet can be fitted readily within the package containing the non-smokable products 10 and will not significantly increase the thickness of the package.

The non-smokable product 10 can with modification to the machinery, be manufactured on conventional cigarette making machinery since most of its components are standard items used in the fabrication of machine-made cigarettes, namely the tobacco element 11 in the filter element 12. The paper wrapper 13 although not necessarily the same as the paper wrapper of a conventional cigarette nonetheless is similar and can be handled in a similar manner by the cigarette making machine. Thus to manufacture the product 10 a continuous strip of wrapper material is drawn into the machine (not shown), formed into a trough into which tobacco elements 11 separated by filter elements 12 are added in a continuous manner. The wrapper material is sealed around the tobacco and filler into a tube which is then cut into discrete lengths each including at one end a filter element 12. The strip of wrapper material can be pre-formed with the holes 14, or alternatively the machine could be modified to form these holes in the manufacturing process.

Although a presently preferred embodiment of the invention has been described above in relation to FIGS. 1 to 3, it will be appreciated that within the scope of the invention, many details of the product combination can be varied. Thus the region 15 where the holes are located could be longer than shown, e.g. it could have a length corresponding to twice the diameter of the product, or even a length of 50% or more of the length of the tobacco element 11. In the embodiment shown the sealing band 20 is of smokable or non-smokable material. However if the region 15 is lengthened as contemplated above, then it would obviously be desirable to utilize a smokable material for the sealing band since otherwise the useful length of the cigarette produced would be unacceptably curtailed.

Furthermore, although the band 20 in the example shown completely covers the holes 14, this is not essential. A band that is narrower than the region of the holes or shorter than the circumference of the article could be used and an acceptable cigarette would result provided that the band covered a sufficient area of the holes 14 to allow an adequate air flow to be drawn through the tip end when the cigarette is smoked.

The sealing band 20 may be provided with any suitable form of adhesive, e.g. a permanently tacky adhesive that is covered by a release sheet, or a water activated adhesive.

The ventilation holes 17 opening into the filter element 12 can be of any desired size to provide a predetermined amount of ventilation into the smoke that is drawn through the filter when the non-smokable product 10 is made up into a cigarette 22 as shown in FIG. 3. Resistance to air flow through the ventilation holes 17 will be substantially constant whether the article is in the raw product condition as shown at 10 in FIG. 1, or made up into a cigarette 22 as shown in FIG. 3. Also for a given size of ventilation holes 14, the air flow through these holes will be substantially different depending on the size of the ventilation holes 17.

Therefore as the size of the ventilation holes 17 is increased, the required minimum size for the holes 14 is reduced. For example if the ventilation holes 17 provide 30% ventilation, then the combined area of the holes 14 can be reduced since these holes are then only required to provide from 60% to 65% of the air flow to ensure that the product 10 is unsmokable.

Although in the embodiments described above the sealing band 0 is self-adhesive and mounted on a backing sheet, a more economical product can be made if instead the sealing band is gummed, i.e. has on one side a dry coating of gum which can be e.g. water-activated at the time of use. This would eliminate the backing sheet (which otherwise would be thrown away) and is obviously lighter and more compact than the sealing band—backing sheet combination.

Alternative means for rendering the non-smokable tobacco product into a smokable condition or possible. Although the embodiments described above utilize an adhesive sealing band 22, the same effect could be achieved by providing a preformed cylindrical band (not shown), adapted to closely surround the periphery of the tubular wrapper 13 and slidable longitudinally thereof to cover the holes 14. The preformed band can have dimensions similar to the made-up sealing band as shown in FIG. 3, but of course since it is preformed it need not include any means to effect adhesion to the wrapper 13 around the holes 14. Such a preformed cylindrical band could be provided in the form of a flattened cylinder of cigarette paper of suitable dimensions, the cylinder being perforated to provide for its easier separation into lengths corresponding to the width of the sealing band 20, such lengths when separated being readily expanded to cylindrical form so that they can be slipped over the product 10 from one end or the other. The preformed band or ring will preferably have a circumference that is very closely matched to that of the product 10 so as to minimize leakage of air past the preformed band when installed in position over the openings 14. Such a preformed band can however still be readily positioned since the product 13 can be readily compressed by hand to ease passage of the preformed band therealong.

Figure 4:
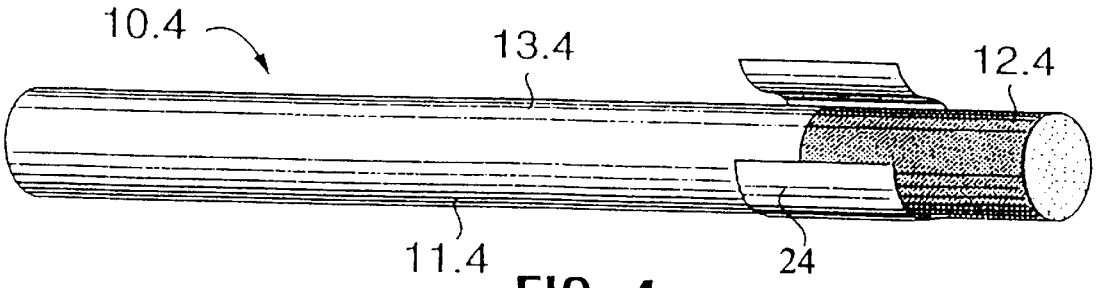
FIG. 4 is a perspective view showing a preferred embodiment of non-smokable tobacco product.

The non-smokable tobacco product 10.4 shown in FIG. 4 comprises a rod-shaped tobacco element 11.4 arranged coaxially end-to-end with a filter element 12.4 and interconnected thereto by an attachment strip 24 comprising a narrow band which is wrapped around and adheres to the adjacent ends of the tobacco element and the filter element. The tobacco element 11.4 has a tubular wrapping 13.4 of normal cigarette paper or other appropriate foil which is substantially impermeable to the flow of air therethrough, although as is known, the wrapper may be slightly permeable so as to allow some air to mix with the smoke as in the conventional application of cigarette ventilation. The product 10 is rendered unsmokable by the fact that the filter element 12.4 is not wrapped, or is wrapped with a highly porous foil, e.g. such as is used in a tea bag, having a permeability to air flow of the order of 10,000 to 30,000 Coresta units. This permeability in the filter region is sufficient to render the product 10.4 unsmokable since it will prevent any significant air flow from passing through the tobacco element 11.4.

To render the product 10.4 of FIG. 4 into a smokable condition a foil (not shown) which is impermeable (or only slightly permeable) to air flow therethrough is wrapped around the filter element 12.4 to inhibit air flow through the peripheral surface thereof, whereupon the product can be smoked in the manner of a conventional cigarette. This foil may take many forms, for example it may have a water activated adhesive on one surface, or may have a permanently tacky adhesive covered by a peelable release sheet. In another version the foil may be of a preformed tubular shape sized to be slipped over the filter element to closely surround the surface thereof.

Figure 5:
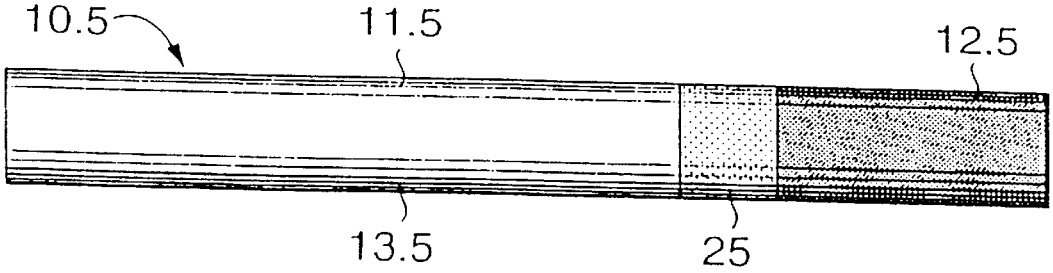
FIG. 5 is a side elevational view of a further embodiment of non-smokable tobacco product.

The non-smokable tobacco product 10.5 shown in FIG. 5 comprises a rod-shaped tobacco element 11.5 and a rod-shaped filter element 12.5 coaxially arranged end-to-end. The tobacco element 11.5 is wrapped by a conventional cigarette paper or foil 13.5 having a low or no permeability to the flow of air therethrough, with the exception of a short porous section 25 adjacent the filter, the wrapper of this porous section having a permeability to the flow of air therethrough greater than 10,000 Coresta units. The filter element 12.5 is of conventional form being wrapped in a known tipping layer of low or no air permeability. The product 10.5 can be rendered smokable by any of the techniques described in relation to the embodiment of FIGS. 1 to 3, e.g. by using a strip form or tubular sealing band.

The porous section 25 of the wrapper 13.5 could conceivably extend as much as the full length of the tobacco element 11 and in that case the entire length would have to be wrapped in an outer foil to render the product smokable, the resulting cigarette being of "double wrap" construction having a conventional cigarette paper superimposed over the highly porous paper.

Figure 6A:
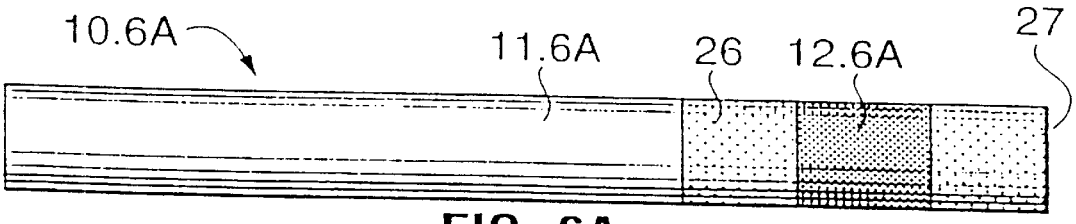
FIGS. 6A and 6B are side elevational views showing still further embodiments of non-smokable tobacco products.

Referring now to the embodiments of FIG. 6, the non-smokable tobacco product 10.6A in FIG. 6A has a tobacco element 11.6A covered in a conventional tubular wrapper having a short porous section 26 adjacent the filter. The filter element 12.6A has at the end thereof an unwrapped section 27 which has a highly porous surface. The product 10.6A is thus rendered unsmokable by virtue of the porous sections 26 and 27, and can be converted into a smokable condition by the application to the sections of a substantially impervious wrapper as described in the foregoing.

Figure 6B:
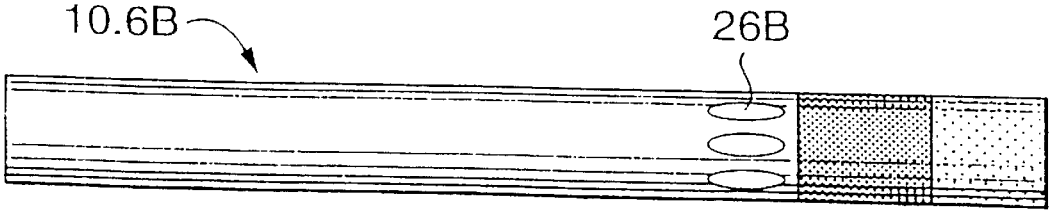

The non-smokable tobacco product 10.6B of FIG. 6B is similar to that of FIG. 6A except that the porous section 26B of the tobacco element thereof is provided by a series of vent holes much as described in relation to the embodiment of FIGS. 1 to 3. As before, the vent holes and the porous section of the filter can be covered by one or two wrappers to make the product smokable.

Figure 7A:
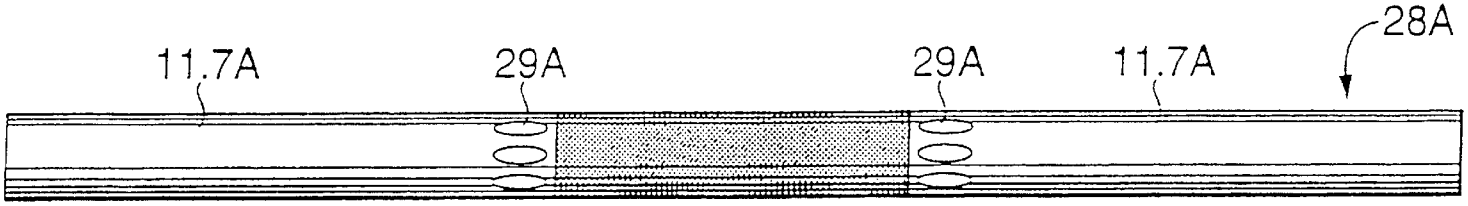
FIGS. 7A through 7D are side elevational views showing further embodiments of non-smokable tobacco products.

FIGS. 7A through 7D show embodiments that include further developments of the concepts described above in relation to FIGS. 1 through 6B, with the additional aspect that each product is of double length, designed to be separated in the middle thereof to provide two smokable cigarettes. Thus it will be seen that FIG. 7A shows a non-smokable tobacco product 28A which includes two tobacco elements 11.7A arranged at opposite lengths of a double length filter element 12.7A. The tobacco elements 11.7A and the filter element 12.7A are covered by conventional foils of no or low permeability. However each of the tobacco elements 11.7A has at the end thereof adjacent the filter element a band of peripheral perforations 29A. Thus when the product is severed at the mid-point of its length, the two resulting products are also unsmokable because of the presence of the perforations 29A, these half products being in fact similar to the non-smokable tobacco product 10 of FIG. 1.

Figure 7B:
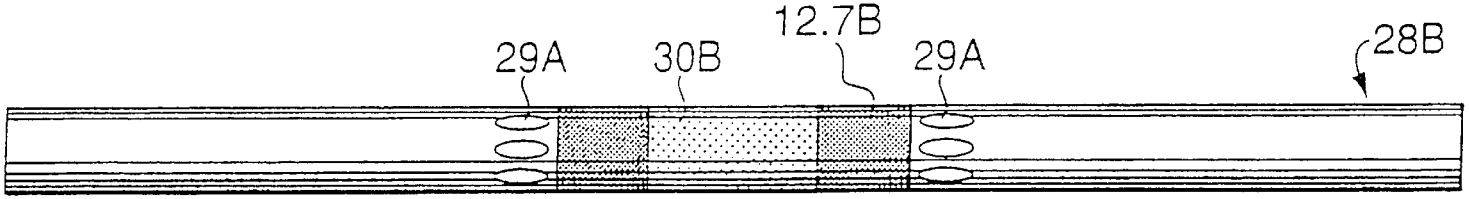

Similarly, the non-smokable tobacco product 28B of FIG. 7B comprises two tobacco elements 11.7B as in FIG. 7A and a common filter element 12.7B, the latter however including an unwrapped central section 30B as described in relation to FIG. 4. It will be appreciated that the product 28B is unsmokable as illustrated and when cut in half will render two unsmokable products which are substantially the same as the product shown in FIG. 6B.

Figure 7C:
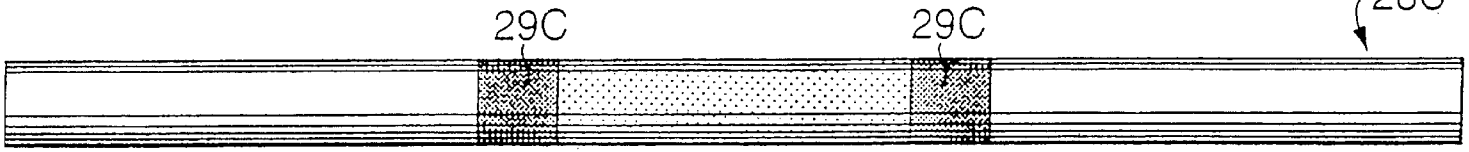
Figure 7D:
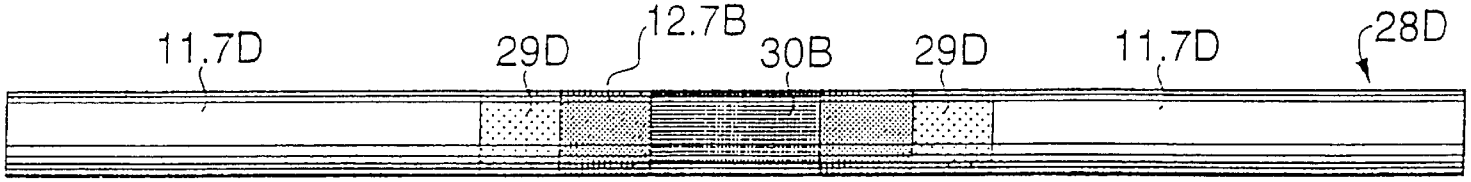

The product 28C shown in FIG. 7C is similar to that shown in FIG. 7A except that the band of perforations 29A is replaced by a band 29C of high porosity or permeability to air flow as described above in relation to the embodiment of FIG. 5, so that when cut in half it will result in two products substantially identical to FIG. 5. The embodiment of FIG. 7D shows a non-smokable tobacco product 28D that combines features from the embodiments of FIGS. 7B and 7C so that in the center of the filter element 12.7D there is an unwrapped filter section 30D, and each adjacent end of the tobacco elements 11.7D has a porous section 29D therein.

The products and features described above and illustrated in the drawings can be used in various combinations to produce unsmokable tobacco products which can be converted into smokable cigarettes by the consumer. The foregoing are given by way of example only, and the invention extends to all such products that fall within the scope of the appended claims.

What is claimed is:

1. A tobacco product comprising:

a rod-shaped element of cigarette tobacco coaxially interconnected to a rod-shaped filter element, with respective first ends of said elements adjoining;

a tubular wrapper enclosing said tobacco element, said wrapper being of smokable material;

the first end of said filter element being wrapped by and adhered to a substantially impervious circumferential strip of material that is carried by said tobacco element;

said filter element having a peripheral surface that is highly porous thus rendering said product unsmokable in that when air is drawn from said product through the second free end of said filter element, the major portion of such air is drawn through said highly porous peripheral surface and any air flow drawn longitudinally through said tobacco element is insufficient to propagate combustion at the tip end thereof or to cause any appreciable amount of smoke to flow through said filter element to the second end thereof;

in combination with a preformed tubular band of flexible substantially impervious material having a width corresponding to that of the highly porous surface of said filter element, and a circumference corresponding to that of said product, said band being slidable on said product to a position overlying said highly porous peripheral surface to render said product smokable.

2. A tobacco product as claimed in claim 1 wherein the porosity of said peripheral surface of said filter element is such as to ensure that at least 90 percent of air flow drawn from said filter second end will enter said product through said highly porous peripheral surface.

3. A tobacco product as claimed in claim 2 wherein less than 9 percent of air drawn through said filter enters said product through the tip end of said tobacco element.

4. A tobacco product as claimed in claim 1 wherein said circumferential strip of material constitutes a discrete attachment strip that is also wrapped around and adhered to said tubular wrapper at the first end of said tobacco element.

5. A tobacco product as claimed in claim 1 wherein the tobacco in said rod-shaped tobacco element is more densely packed at the tip end thereof than elsewhere in the length of said tobacco element.

6. A tobacco product as claimed in claim 1 wherein said highly porous peripheral surface of said filter has a permeability to air of at least 1500 coresta units (cc/min/$c^2$).

7. A tobacco product as claimed in claim 1 wherein said preformed tubular band is provided in the form of a flattened paper cylinder which after expanding to cylindrical form can be slid over the tobacco product from one end or the other.

8. A tobacco product comprising two products as claimed in claim 1 arranged end-to-end with integrally connected rod-shaped filter elements, said product being severable between said filter elements to produce two tobacco products.

* * * * *